US010610067B2

(12) United States Patent
Watschinger et al.

(10) Patent No.: US 10,610,067 B2
(45) Date of Patent: Apr. 7, 2020

(54) TOILET SEAT

(71) Applicants: Karl Watschinger, Kaprun (AT); Peter Mayr, Piesendorf (AT)

(72) Inventors: Karl Watschinger, Kaprun (AT); Peter Mayr, Piesendorf (AT)

( * ) Notice: Subject to any disclaimer, the term of this patent is extended or adjusted under 35 U.S.C. 154(b) by 0 days.

(21) Appl. No.: 15/696,748

(22) Filed: Sep. 6, 2017

(65) Prior Publication Data

US 2018/0020888 A1 Jan. 25, 2018

Related U.S. Application Data

(63) Continuation of application No. PCT/AT2016/000017, filed on Feb. 25, 2016.

(30) Foreign Application Priority Data

Mar. 13, 2015 (AU) ..... A 139/2015

(51) Int. Cl.
*A47K 13/12* (2006.01)
*A47K 13/26* (2006.01)
*A47K 13/02* (2006.01)

(52) U.S. Cl.
CPC ..... *A47K 13/12* (2013.01); *A47K 13/02* (2013.01); *A47K 13/26* (2013.01)

(58) Field of Classification Search
USPC ..... 4/236
See application file for complete search history.

(56) References Cited

U.S. PATENT DOCUMENTS

| | | | | |
|---|---|---|---|---|
| 3,471,874 A | 10/1969 | Dixon | | |
| 3,653,077 A * | 4/1972 | Warnberg | ..... | A47K 13/12 16/229 |
| 3,802,000 A * | 4/1974 | Waldon | ..... | A47K 13/12 4/236 |
| 4,639,147 A * | 1/1987 | Schwarz | ..... | A47K 13/12 114/144 R |
| 4,729,134 A * | 3/1988 | Hillebrand | ..... | A47K 13/12 16/266 |
| 6,243,884 B1 * | 6/2001 | Simonson | ..... | A47K 13/12 220/831 |

FOREIGN PATENT DOCUMENTS

| | | | | |
|---|---|---|---|---|
| DE | 202008013712 U1 | 3/2009 | | |
| DE | 202009008303 U1 | 8/2009 | | |
| EP | 0225427 A2 * | 6/1987 | ..... | A47K 13/12 |
| EP | 0225427 A2 | 6/1987 | | |
| EP | 2263505 A2 | 12/2010 | | |
| FR | 1200475 A | 12/1959 | | |
| JP | H0548798 U | 6/1993 | | |
| WO | 9111951 A1 | 8/1991 | | |

OTHER PUBLICATIONS

EP0225427.*

* cited by examiner

*Primary Examiner* — Lauren A Crane
(74) *Attorney, Agent, or Firm* — Laurence A. Greenberg; Werner H. Stemer; Ralph E. Locher

(57) ABSTRACT

A toilet seat has a toilet seat ring and two coaxial hinges which have two mutually spaced-apart bearing pins and hinge sleeves molded onto the toilet seat ring. The two hinge sleeves slide onto the journals from the same side.

10 Claims, 6 Drawing Sheets

TOILET SEAT

CROSS-REFERENCE TO RELATED APPLICATION

This application is a continuation, under 35 U.S.C. § 120, of copending international application No. PCT/AT2016/000017, filed Feb. 25, 2016, which designated the United States; this application also claims the priority, under 35 U.S.C. § 119, of Austrian patent application No. AT A139/2015, filed Mar. 13, 2015; the prior applications are herewith incorporated by reference in their entirety.

BACKGROUND OF THE INVENTION

Field of the Invention

The present invention relates to a toilet seat having a toilet-seat ring and having two coaxial hinges which have spaced-apart bearing pins and hinge sleeves, which are integrally formed on the toilet-seat ring. The pushed-on toilet-seat ring is secured against axial displacement by a stop. The toilet-seat ring is preferably assigned a toilet-seat lid which can both be pivoted upward jointly and on its own about the same hinge axis.

The currently most common method of fastening toilet seats on a toilet bowl makes use of the screw connection of bearing pins which are oriented in opposite directions and of which the threaded pins are guided through holes in the toilet bowl and are fastened on the underside of an upper collar of the bowl. The bearing pins engage in hinge sleeves provided for this purpose, preferably holes or eyelets in the toilet-seat ring and the toilet-seat lid, which thus cannot be separated either during installation or during removal.

The fact that this connection between the toilet-seat ring/toilet-seat lid and the toilet bowl is not freely accessible means that thorough cleaning of the hinge region is compromised and the bearing pins engage in cavities which form regions that are not accessible either.

It is particularly in hospitals, care homes or the like that it is extremely important to provide anything from effective cleaning to sterilization in order to stem the spread of pathogenic bacteria, infectious viruses, fungi and parasites. Straightforward removal of the toilet seats is advantageous for this purpose.

A toilet-seat ring which can be removed without any technical support is known from German utility model (Gebrauchsmuster) DE 202008013712 U. In the latter document, the bearing pins of the hinges have parallel flattened portions on either side, and the hinge sleeves are each provided with a longitudinal slot which weakens the hinge sleeve, it therefore being possible for the toilet-seat ring to be drawn off in the upward direction at an angle of approximately 75°. It is preferably also the case that the hinge sleeves of the toilet-seat lid have identical longitudinal slots. It is thus possible for the toilet-seat ring and toilet-seat lid to be removed jointly or separately in the angled position.

U.S. Pat. No. 4,639,147 discloses a friction brake which is intended for a pivot joint and can also be installed in a toilet seat. A toilet-seat ring is pushed axially onto two coaxial bearing pins which are oriented in the same direction and of which one is provided with a thread. In order to prevent the toilet-seat ring, once swung upward, from falling downward accidentally, an elastic sleeve is compressed on the bearing pin by a screw nut, which, as it additionally serves as a stop, also axially secures the toilet-seat ring. This does, indeed, achieve fixed connection between the toilet-seat ring and the toilet bowl in a manner which requires only a low level of technical outlay, but it does not provide for straightforward installation and removal for cleaning purposes.

SUMMARY OF THE INVENTION

It is accordingly an object of the invention to provide a toilet seat assembly which overcomes the above-mentioned and other disadvantages of the heretofore-known devices and methods of this general type and which provides for the desired straightforward installation and removal. The object is achieved, according to the invention, in the case of a toilet seat of the type mentioned in the introduction, in that the stop which secures against axial displacement is formed by a clamp element which engages around at least one hinge.

With the foregoing and other objects in view there is provided, in accordance with the invention, a toilet seat, comprising:

a toilet-seat ring;

two mutually coaxial hinges having hinge sleeves integrally formed on the toilet-seat ring and spaced-apart bearing pins, wherein the hinge sleeves are pushed onto the bearing pins from a common side;

a stop disposed to secure the toilet-seat ring against axial displacement from a position in which the hinge sleeves are pushed onto the bearing pins, the stop being a clamp element that engages around at least one of the two hinges.

A preferred embodiment makes provision for the stop to be formed on the toilet-seat lid, which can be pivoted upward coaxially with the toilet-seat ring. Installation of the toilet-seat lid thus prevents displacement of the previously installed toilet-seat ring. The toilet-seat lid, for its part, does not need to be retained mechanically to such a great extent, for which reason the toilet-seat lid can be fixed in any desired suitable manner, for example by magnetic coupling, by latching or by a straightforward lock system between the toilet-seat ring and the toilet-seat lid. For example it is possible for crosspieces with coaxial depressions, eyelets or the like to project inward, in the form of stops, from the toilet-seat lid and to engage, in the manner of a clamp element, over a hinge, both hinges or the entire hinge region. In the case of a toilet-seat lid which is usually produced from plastics material, such inwardly projecting stops are sufficiently elastic to allow them to be latched on axially oppositely oriented or axially facing end regions of the bearing pins. It is further also possible for the stop to be active only when the toilet-seat lid has been pivoted upward, and therefore the toilet-seat lid can be pushed onto the bearing pins from the side, with abutment against the toilet-seat ring.

Locking of the toilet-seat ring by the toilet-seat lid has the further advantage of it being possible for the bearing pins of the two hinges to be installed beforehand, for example also adhesively bonded, on the toilet bowl. In a preferred embodiment, provision is further made for the bearing pins to be integrally formed on the toilet bowl. This means that it is also possible for those regions between the toilet bowl and the hinges screwed thereon which remain a problem in all the other systems to be avoided.

Other features which are considered as characteristic for the invention are set forth in the appended claims.

Although the invention is illustrated and described herein as embodied in a toilet seat, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
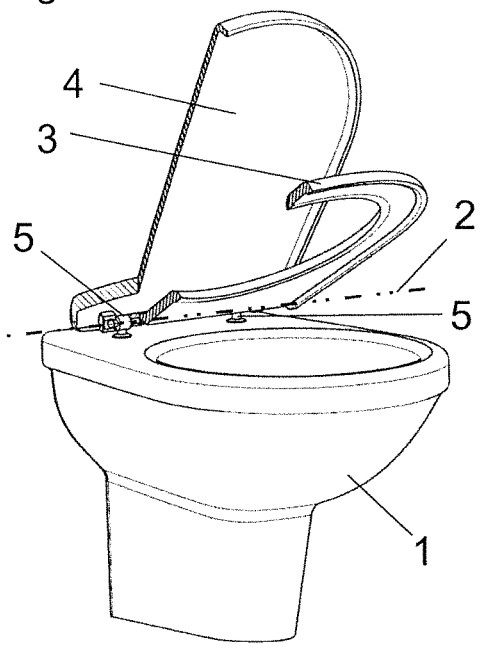
FIG. 1 is a perspective view, partly in section, of a first embodiment of a toilet bowl with a toilet seat according to the invention.
Figure 2:
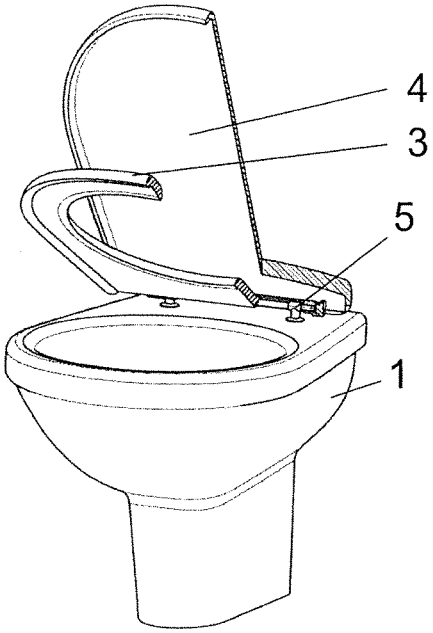
FIG. 2 is a similar perspective view, partly in section, of the first embodiment of the toilet bowl with the toilet seat.

Referring now to the figures of the drawing in detail and first, particularly, to FIGS. 1 and 2 thereof, there is shown a conventional toilet bowl 1 with a first, simple embodiment of a toilet seat comprising a toilet-seat ring 3 and a toilet-seat lid 4. The toilet seat is fastened on the toilet bowl 1 in a conventional manner by way of two coaxial hinges 5. Each hinge 5 has a threaded pin or the like, which extends through openings of the toilet bowl 1 and is fastened on the underside by an easily releasable closure nut (not illustrated). The toilet-seat ring 3 and the toilet-seat lid 4 can both be pivoted, independently of one another or jointly, about the hinge axis 2 predetermined by the hinges 5.

Figure 3:
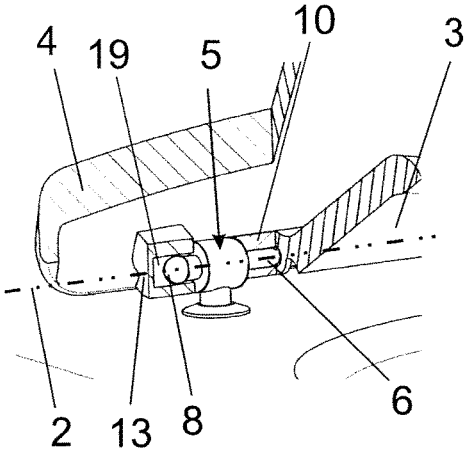
FIGS. 3 and 4 show an enlargement of the hinge region from FIGS. 1 and 2.
Figure 4:
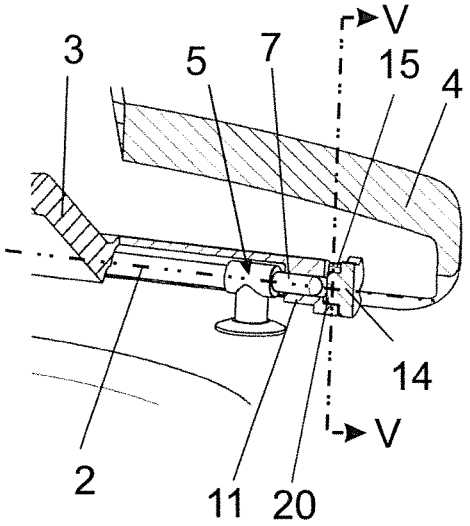
Figure 14:
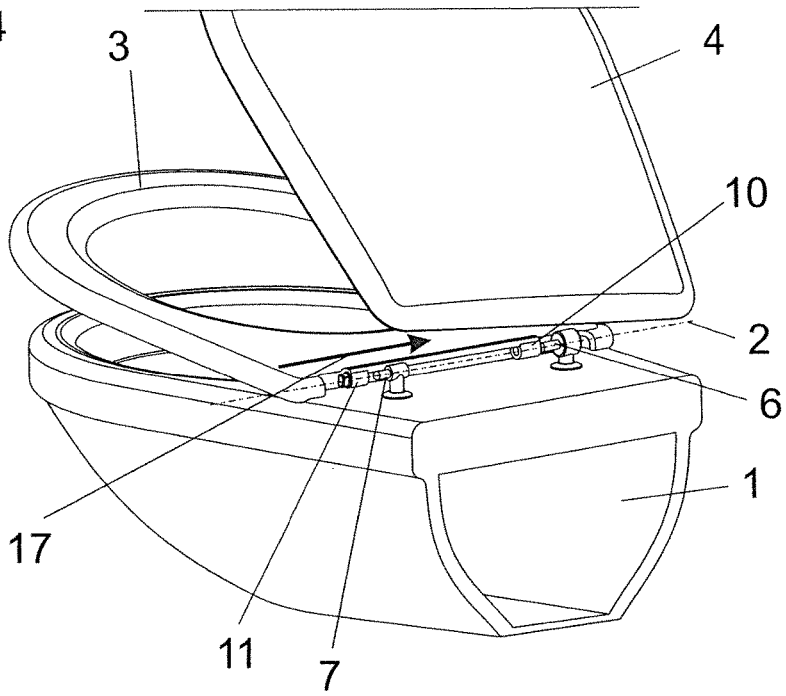

The two hinges 5 are designed differently, as can be seen in detail from FIGS. 3 and 4. Both hinges 5 have a bearing pin 6, 7 (also referred to as journals 6, 7), these being directed toward the same side, and therefore the toilet-seat ring 3, provided with hinge sleeves 10, 11 (also referred to as hinge casings 10, 11), can be pushed, or has been pushed, onto the bearing pins 6, 7 in the axial direction from said side. This installation step is explained in FIG. 14 by way of the arrow 17. The coaxial displacement onto the bearing pins 6, 7, which project in the same direction from the toilet bowl 1, also allows the toilet-seat ring 3 to be removed quickly and easily in order for the toilet bowl 1 to be cleaned. A difference resides in the formation of a rounded, spherical or mushroom-shaped protrusion 8 on that side of just one of the two hinges 5 which is located axially opposite the bearing pin 6 (FIG. 3).

Figure 5:
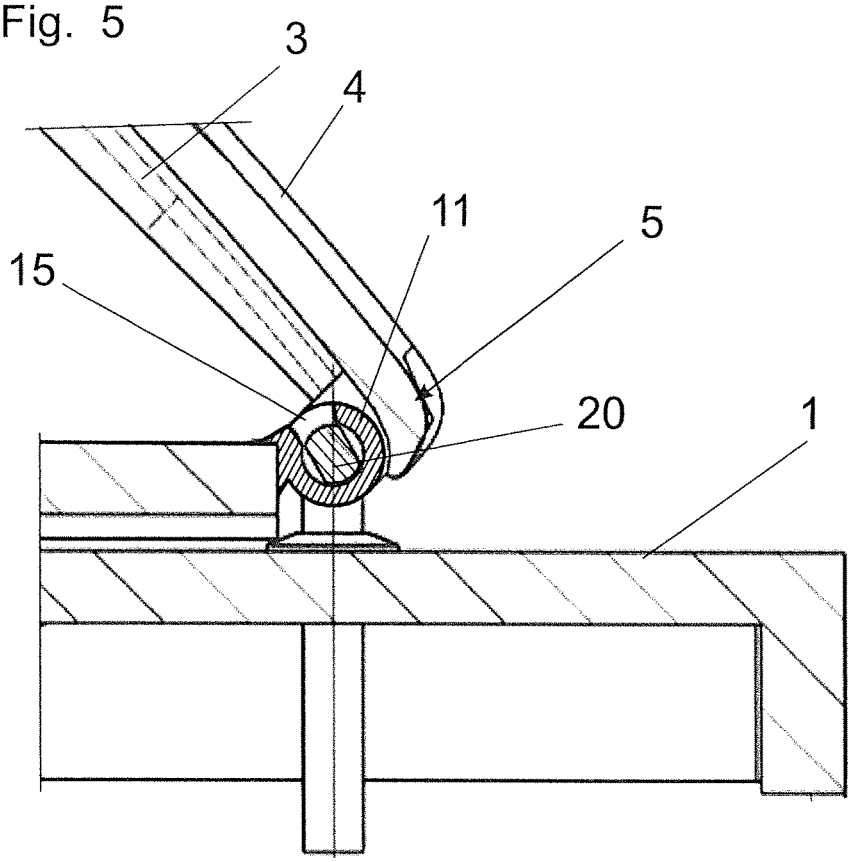
FIG. 5 shows a section taken along the line V-V in FIG. 4.

After being pushed onto the bearing pins 6, 7, the toilet-seat ring 3 is preferably secured against axial displacement. In a preferred embodiment, this is done by the installation of the toilet-seat lid 4, on which two lugs 13, 14 are provided. The lugs 13, 14 also form part of the hinges 5, which allow the toilet-seat lid 4 to pivot about the hinge axis 2. In the embodiment according to FIGS. 3 and 4, the lugs 13, 14 engage over the two hinges from the outside, as a result of which the toilet-seat ring 3 is enclosed in an axially immovable manner. The lug 13 has a depression 19, in which engages the rounded protrusion 8 of the hinge 5 provided with the bearing pin 6 (FIG. 3). The lug 14, which is shown on an enlarged scale in FIG. 4, is provided with a crosspiece-like protrusion 20, which engages in the end-side opening of the hinge sleeve 11 of the toilet-seat ring 3, said hinge sleeve having been pushed onto the bearing pin 7. The free end of the hinge sleeve 11, said end being directed toward the lug 14, is provided with a slot 15 (FIG. 5) and therefore, once the toilet-seat lid 4 has been fitted on the rounded protrusion 8, the crosspiece-like protrusion 20 can be introduced into the hinge sleeve 11 through the slot 15, in accordance with arrow 18 in FIG. 15. The toilet-seat lid 4 here is located in a central oblique position, from which it can be pivoted about the hinge axis 2 in the downward direction onto the toilet-seat ring 3 or in the upward direction into an open position, wherein the protrusion 20 rotates within the hinge sleeve 11, as can be seen to better effect from FIG. 5.

Figure 6:
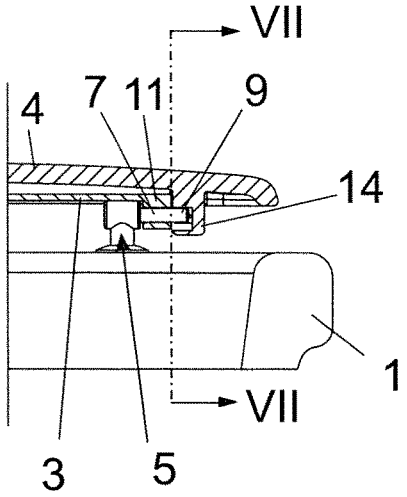
FIG. 6 shows an axial section through the pivoted-down toilet seat according to a second embodiment.
Figure 7:
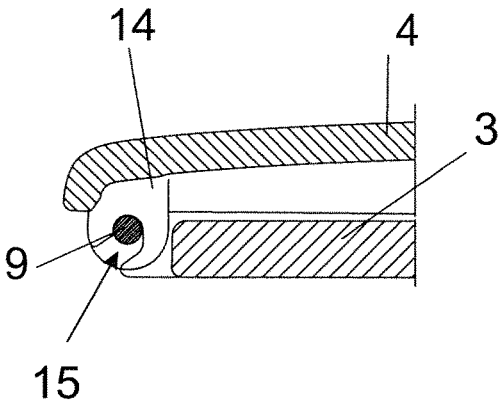
FIG. 7 shows a section taken along line VII-VII in FIG. 6.

FIGS. 6 and 7 show a second embodiment, in which, with the construction otherwise being the same, the bearing pin 7 is longer and has an end portion 9 projecting from the hinge sleeve 11. In this embodiment, it is also the case that the lug 14, in a manner similar to the lug 13, is provided with a depression in which the projecting end portion 19 of the bearing pin 7 engages. The lugs 13, 14 preferably have at least such elasticity as to allow them to be snap-fitted onto the protrusion 8 of the bearing pin 6 and the end portion 9 of the bearing pin 7 and also to be removed again therefrom. The two lugs 13, 14 engage axially over the two hinges 5 and fix the toilet-seat ring 3 in a clamp-like manner in the axial direction.

Figure 15:
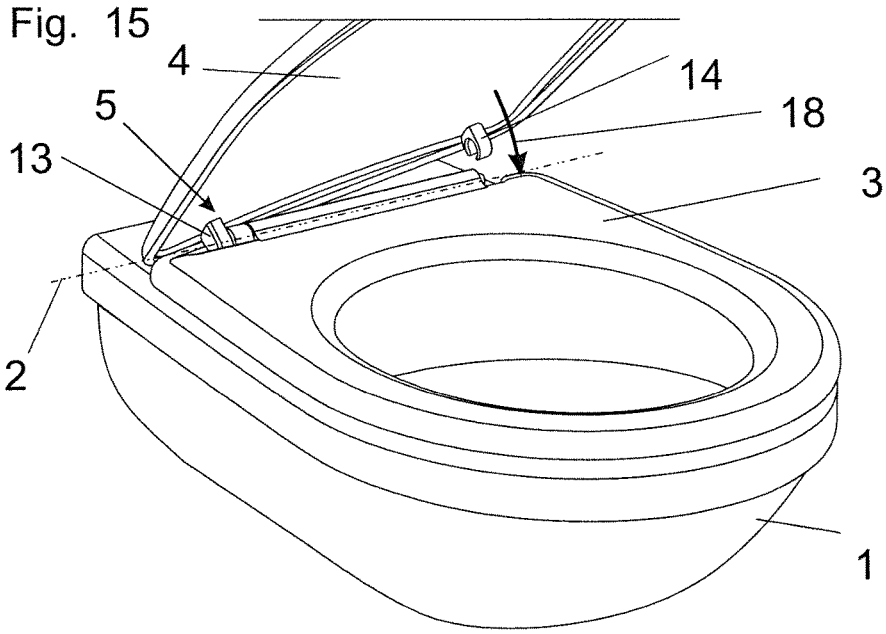

FIG. 7 shows the possibility of the lug 14 having a slot 15, in which case, instead of the elastic widening, the final step for installing the toilet-seat lid 4, constitutes pivoting in accordance with arrow 18 in FIG. 15, wherein the lug 14 is introduced into the end portion 9.

Figure 8:
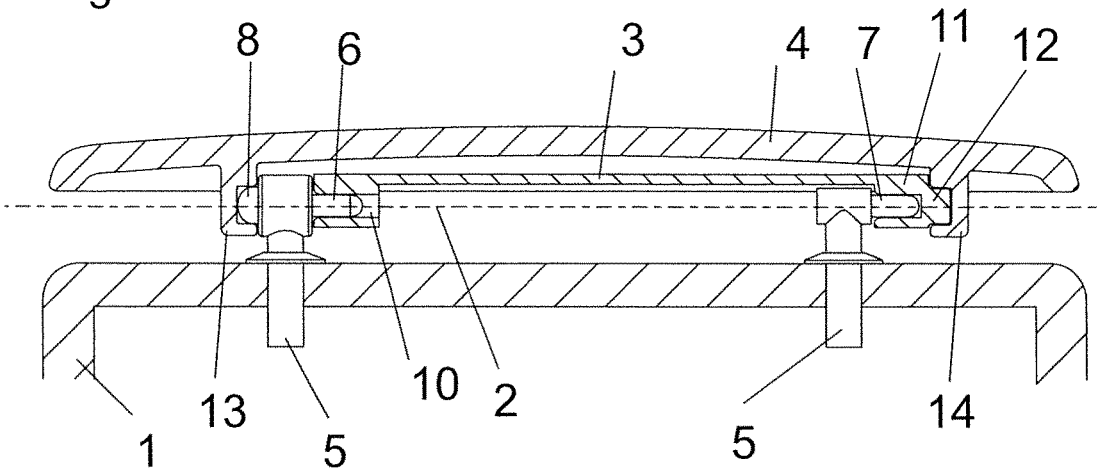
FIG. 8 shows an axial section similar to FIG. 6, but this time through a third embodiment.

FIG. 8 shows a third embodiment, in which, with the construction otherwise being the same, the hinge sleeve 11 pushed onto the bearing pin 7 has an axial protrusion 12, on which the lug 14, which is provided with a depression, is mounted in a pivotable manner. In this embodiment, the two lugs 13, 14 are preferably elastic in order to be latched onto the protrusions 8, 12, although it is also conceivable here for the lug 14 to have a slot for the introduction of the protrusion 12.

Figure 9:
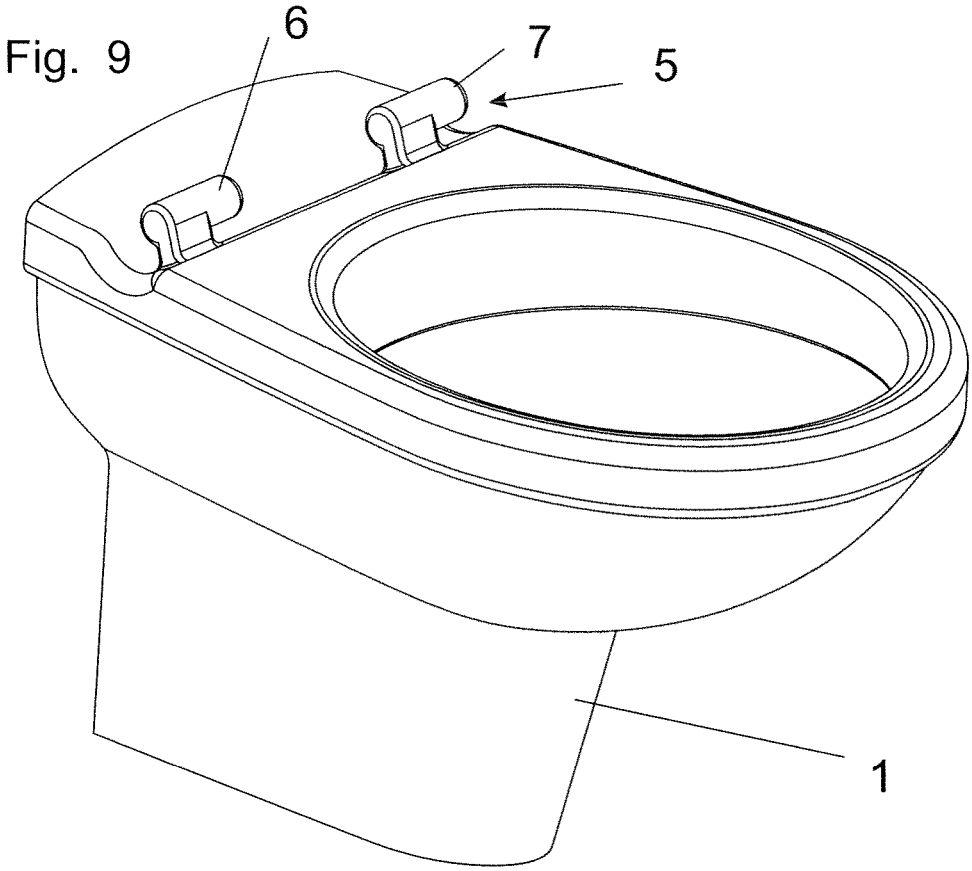
FIG. 9 shows a first embodiment of a toilet bowl with integrally formed bearing pins.
Figure 11:
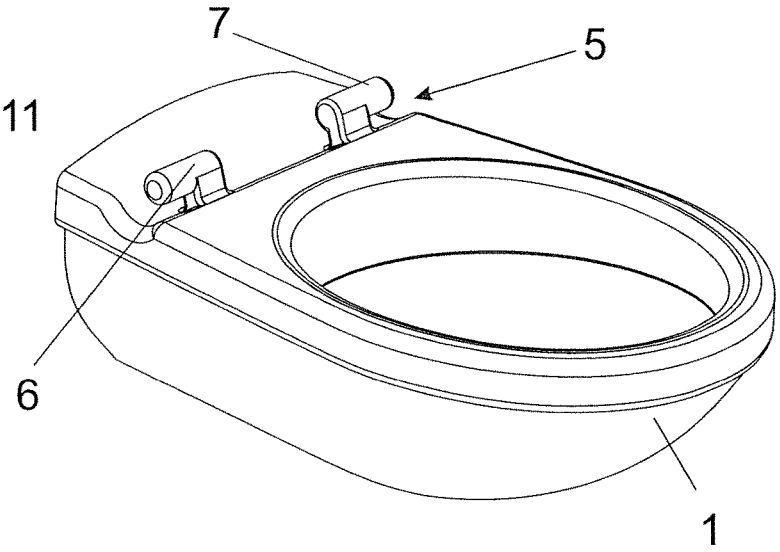
FIG. 11 shows a second embodiment of a toilet bowl with integrally formed bearing pins.

FIGS. 9 and 11 show two exemplary embodiments of toilet bowls 1 in which the bearing pins 6, 7 of the hinges are integrally formed directly. Since there are no fastening elements of any kind here screwed, adhesively bonded or magnetically fastened to the toilet bowl, there is no additional gap or cavity which can be cleaned only with difficulty, if at all.

Figure 10:
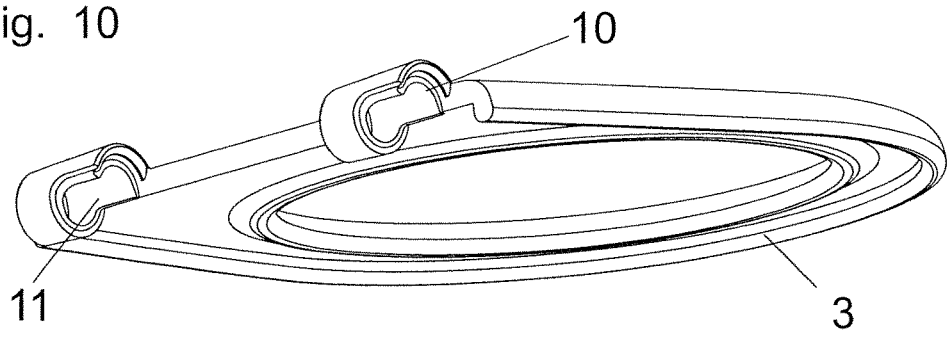
FIG. 10 shows a perspective view from beneath of a toilet-seat ring for the toilet bowl according to FIG. 9.

A toilet-seat ring 3 can be pushed laterally onto the toilet bowl 1 shown in FIG. 9 if the said toilet-seat ring 3, as shown in FIG. 10, has identical hinge sleeves 10 and 11, wherein the operation of latching the toilet-seat lid 4 is possible in a manner similar to the procedure described in respect of FIG. 8 in particular when the hinge sleeves 10, 11 are longer than the bearing pins 6, 7 and the lugs 13, 14, instead of depressions, have rounded protrusions which latch into the ends of the hinge sleeves 10, 11.

Figure 12:
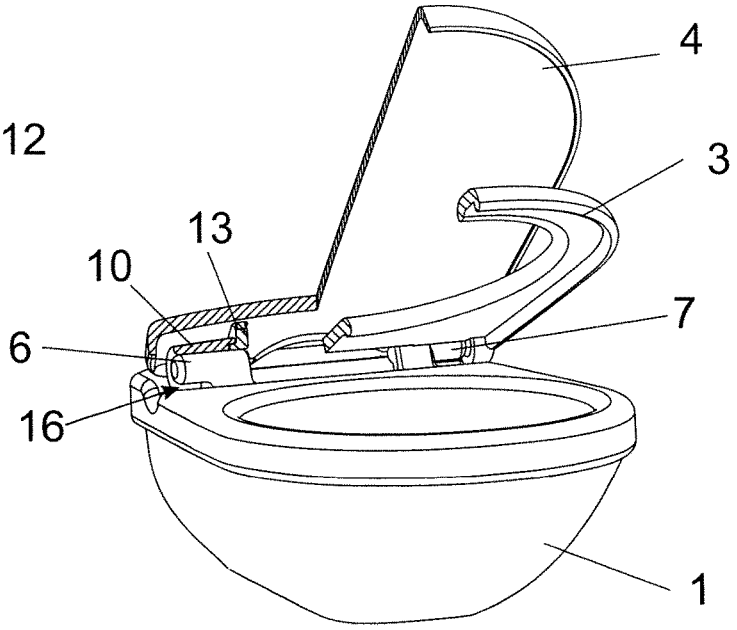
FIG. 12 is a perspective view of a toilet bowl according to FIG. 11 with a toilet seat partly in section.
Figure 13:
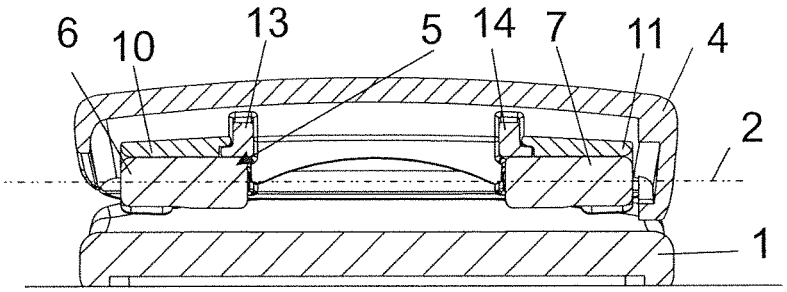
FIG. 13 shows an axial section through the pivoted-down toilet seat of the embodiment according to FIG. 11, FIGS. 14 and 15 show two basic positions of a toilet seat during the installation operation.

The toilet bowl 1 shown in FIG. 11 has bearing pins 6, 7 which are oriented, in a known manner, in opposite directions. A lateral pushing-on action is possible here too if the hinge sleeve 10 is provided with a slot 16 (FIG. 12) and can be pushed over the point of connection between the toilet bowl 1 and the hinge 5. The toilet-seat ring 3 is secured axially, once again, by the toilet-seat lid 4, of which the two lugs 13, 14, as FIG. 13 shows, engage between the two hinges 5.

Figure 16:
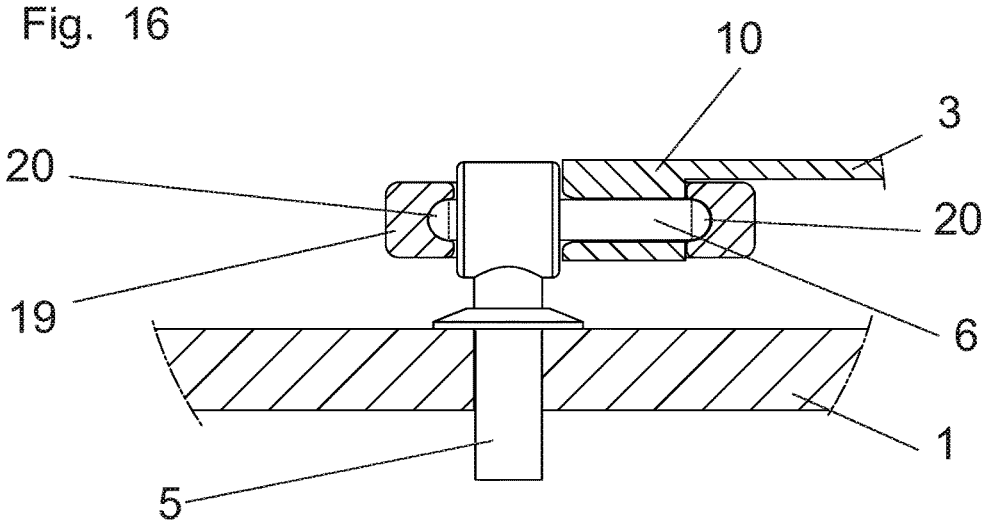
FIG. 16 shows an enlarged detail of a hinge with a schematic diagram of a clamp element engaging around a hinge.
Figure 17:
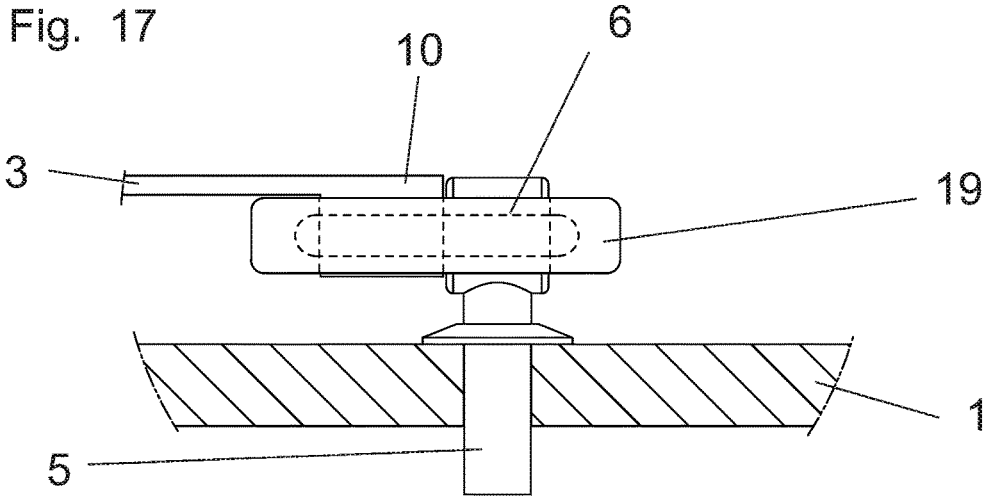
FIG. 17 shows the view from the opposite side.
Figure 18:
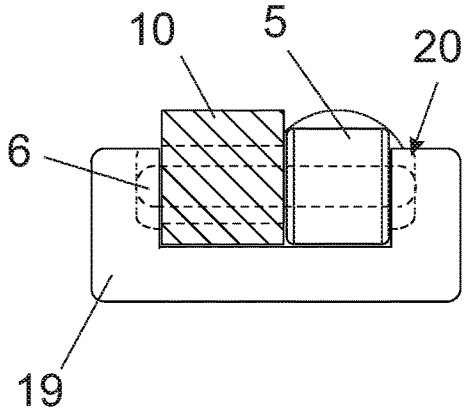
FIG. 18 shows a plan view of the hinge with the clamp around it.

FIGS. 16 to 18 show an embodiment in which, rather than a toilet-seat lid 4, a straightforward clamp element 19, in particular one made of an elastic plastics material, is provided on one or both hinges 5 in order to secure against axial displacement of the toilet-seat ring 3. The clamp element 19 is provided internally with a groove 20 on either side and is pushed onto the rounded ends of the bearing pin 6 which project on either side from the hinge 5 and the hinge sleeve 10. The secured hinge 5 is shown in axial section in FIG. 16, from the rear side in FIG. 17 and in plan view in FIG. 18.

The invention claimed is:

1. A toilet seat, comprising:

a toilet-seat ring pivotable about a hinge axis to be mounted on a toilet bowl;

two mutually coaxial hinges disposed at a fixed spacing distance, said coaxial hinges having hinge sleeves integrally formed on said toilet-seat ring and spaced-apart bearing pins to be mounted on the toilet bowl, or integrally formed on the toilet bowl, at the fixed spacing distance;

said hinge sleeves having openings pointing sideways in a first common direction, and said bearing pins pointing sideways in a second common direction, said second common direction being opposite said first common direction, wherein, in order to mount said toilet-seat ring on the toilet bowl, said hinge sleeves are axially pushed onto said bearing pins from a common side; and a toilet seat lid mounted for pivoting about said hinge axis, said toilet seat lid having two lugs projecting from said toilet seat lid, said toilet seat lid and said lugs defining a clamp element pivotable about said hinge axis, said clamp element engaging around at least one of said two hinges, wherein said lugs form a stop disposed to secure said toilet-seat ring against axial displacement in said first and second common directions from a position in which said hinge sleeves are pushed onto said bearing pins.

2. The toilet seat according to claim 1, wherein said lugs of the toilet-seat lid are latched onto axially oppositely oriented end regions of said two hinges in a direction perpendicular to the hinge axis.

3. The toilet seat according to claim 2, wherein one of said lugs of the toilet-seat lid has an opening into which a protrusion of one of said hinges engages, and another of said lugs has a protrusion formed thereon which projects into one of said hinge sleeves of said toilet-seat ring.

4. The toilet seat according to claim 1, wherein said toilet-seat lid is latched in between axially facing end regions of said two bearing pins, in a direction perpendicular to the hinge axis.

5. A toilet, comprising:

a toilet bowl; and a toilet seat according to claim 1;

wherein the bearing pins are integrally formed on the toilet bowl.

6. A toilet seat, comprising:

a toilet-seat ring pivotable about a hinge axis to be mounted on a toilet bowl;

two mutually coaxial hinges with a fixed spacing distance, said coaxial hinges having hinge sleeves integrally formed on said toilet-seat ring and spaced-apart bearing pins to be mounted on the toilet bowl, or integrally formed on the toilet bowl, at the fixed spacing distance;

said hinge sleeves having openings pointing sideways in a first common direction, and said bearing pins pointing sideways in a second common direction, said second common direction being inverse to said first common direction, wherein, in order to mount said toilet-seat ring on the toilet bowl, said hinge sleeves are pushed onto said bearing pins from a common side; and a clamp element having two lugs pivotable about said hinge axis, said clamp element engaging around at least one of said two hinges, said lugs being disposed to secure said toilet-seat ring against axial displacement in said first and second common direction from a position in which said hinge sleeves are pushed onto said bearing pins, wherein said lugs are latched onto axially oppositely oriented end regions of said two hinges.

7. The toilet seat according to claim 6, wherein one of said lugs of said clamp element has an opening into which a protrusion of one of said hinges engages, and another of said lugs has a protrusion formed thereon which projects into one of said hinge sleeves of said toilet-seat ring.

8. A toilet, comprising:

a toilet bowl; and a toilet seat according to claim 6;

wherein the bearing pins are integrally formed on the toilet bowl.

9. A toilet seat, comprising:

a toilet-seat ring pivotable about a hinge axis to be mounted on a toilet bowl;

two mutually coaxial hinges with a fixed spacing distance, said coaxial hinges having hinge sleeves integrally formed on said toilet-seat ring and spaced-apart bearing pins to be mounted on the toilet bowl, or integrally formed on the toilet bowl, at the fixed spacing distance;

said hinge sleeves having openings pointing sideways in a first common direction, and said bearing pins pointing sideways in a second common direction, said second common direction being inverse to said first common direction, wherein, in order to mount said toilet-seat ring on the toilet bowl, said hinge sleeves are pushed onto said bearing pins from a common side; and a clamp element having two lugs pivotable about said hinge axis, said lugs being disposed to secure said toilet-seat ring against axial displacement in said first and second common direction from a position in which said hinge sleeves are pushed onto said bearing pins, wherein said lugs are latched in between axially facing end regions of said two bearing pins.

10. A toilet, comprising:

a toilet bowl; and a toilet seat according to claim 9;

wherein the bearing pins are integrally formed on the toilet bowl.

* * * * *